US006497405B2

(12) United States Patent
Yu et al.

(10) Patent No.: US 6,497,405 B2
(45) Date of Patent: Dec. 24, 2002

(54) SHEET FEEDING APPARATUS

(76) Inventors: Cheng-Hui Yu, No. 1, Lane 73, Jishiang 7th St., Jian Shiang, Hualien (TW); Yi-Liang Lin, 2 Fl., N. 2-1, Lane 95, Sec. 3, Mushin Rd., Taipei (TW); Shu-Wei Hu, 13 Fl.-2, No.67, Sec. 3, Jingguo Rd., Hsinchu (TW); Chao-Hung Hsiao, 2 Fl. No. 42, Lane 232, Hulin St., Taipei (TW)

( * ) Notice: Subject to any disclaimer, the term of this patent is extended or adjusted under 35 U.S.C. 154(b) by 195 days.

(21) Appl. No.: 09/752,486

(22) Filed: Jan. 2, 2001

(65) Prior Publication Data

US 2002/0084573 A1 Jul. 4, 2002

(51) Int. Cl.[7] ..... B65H 3/06
(52) U.S. Cl. ..... 271/116; 271/118
(58) Field of Search ..... 271/116, 117, 271/118

(56) References Cited

U.S. PATENT DOCUMENTS 5,527,026 A * 6/1996 Padget et al. ..... 271/117
5,547,181 A * 8/1996 Underwood ..... 271/114
5,678,814 A * 10/1997 Yokoyama et al. ..... 271/117

* cited by examiner

*Primary Examiner*—Donald P. Walsh
*Assistant Examiner*—Kenneth W Bower
(74) *Attorney, Agent, or Firm*—Niro, Scavone Haller & Niro

(57) ABSTRACT

A sheet feeding apparatus to be used in an automatic sheet feeder having a motor rotatable in a first direction and a second direction is disclosed. The sheet feeding apparatus includes a first transmission device driven by the motor for generating a driving force, a second transmission device driven by the first transmission device when the driving force for driving the second transmission device is larger than a threshold value, and a third transmission device moving between an initial position and a sheet feeding position and driven by the second transmission device to rotate in the first direction for moving from the initial position to the sheet feeding position where the third transmission device in contact with a sheet while the motor rotates in the first direction and the driving force for driving the second transmission device is smaller than the threshold value so that when the driving force for driving the second transmission device becomes larger than the threshold value, the third transmission device feeds the sheet.

7 Claims, 3 Drawing Sheets

SHEET FEEDING APPARATUS

FIELD OF THE INVENTION

The present invention relates to a sheet feeding apparatus, and more particularly to a sheet feeding apparatus to be used in an automatic sheet feeder.

BACKGROUND OF THE INVENTION

An automatic sheet feeder is widely used in a printer, a fax machine and a scanner. One of the most important components of the automatic sheet feeder is a cantilever sheet feeding apparatus. The typical structure of the cantilever sheet feeding apparatus used in an automatic sheet feeder includes not only a motor for providing power to feed a sheet but also an expensive magnetic valve or another motor for controlling the motion of a cantilever. Such structure has disadvantages of high cost and a complex assembly. Thus, the structure of the sheet feeding apparatus needs to be improved to overcome the above problem.

SUMMARY OF THE INVENTION

It is therefore an object of the present invention to propose a sheet feeding apparatus adapted to be used in an automatic sheet feeder which has a motor rotatable in a first direction and a second direction. The sheet feeding apparatus includes a first transmission device driven by the motor for generating a driving force, a second transmission device driven by the first transmission device when the driving force for driving the second transmission device is larger than a threshold value, and a third transmission device moving between an initial position and a sheet feeding position and driven by the second transmission device to rotate in the first direction for moving from the initial position to the sheet feeding position where the third transmission device is in contact with a sheet while the motor rotates in the first direction and the driving force for driving the second transmission device is smaller than the threshold value so that when the driving force for driving the second transmission device becomes larger than the threshold value, the third transmission device feeds the sheet.

According to an aspect of the present invention, the third transmission device will rotate in the second direction to back to the initial position when the driving force for driving the second transmission device further becomes smaller than the threshold value and the motor rotates in the second direction.

Preferably, the first transmission device includes a first gear driven by the motor, a transmission shaft connected through the first gear, an one way bearing coupled with the transmission shaft, a separation roller coupled with the one way bearing and rotating therewith, and a second gear coupled with the transmission shaft to drive the second transmission device.

Preferably, the one way bearing and the separation roller rotate in the first direction on the transmission shaft while the motor rotates in the first direction and are free to rotate in the first direction while the motor rotates in the second direction.

Certainly, the sheet feeding apparatus can further include a cantilever coupled with the transmission shaft and connected to the second transmission device and the third transmission device.

Preferably, the second transmission device includes a connecting shaft fixed to the cantilever, a third gear coupled with the connecting shaft and meshed with the second gear of first transmission device, a torque limiting module mounted on the connecting shaft and between the connecting shaft and the third gear.

Preferably, the third transmission device includes a sheet feeding shaft coupled with the cantilever, a fourth gear coupled to the sheet feeding shaft and meshed with the third gear, and a sheet feeding roller connected to the fourth gear and also coupled with the sheet feeding shaft, wherein the cantilever is driven by the motor to rotate in the first direction on the transmission shaft to move the sheet feeding roller from the initial position to the sheet feeding position where the sheet feeding roller is in contact with the sheet while the driving force for driving the third gear is smaller than the threshold value and the motor rotates in the first direction. The fourth gear and the sheet feeding roller is driven by the third gear to feed the sheet while a reaction force of the sheet feeding roller in contact with the sheet is generated to make the driving force for driving the third gear larger than the threshold value and the third gear starts to rotate, and then the cantilever driven by motor rotating in the second direction rotates inversely on the transmission shaft and is moved from the sheet feeding position to the initial position while the motor rotates in the second direction and the driving force for driving the third gear is smaller than the threshold value.

The present invention may best be understood through the following description with reference to the accompanying drawings, in which:

DESCRIPTION OF THE PREFERRED EMBODIMENTS

Figure 1:
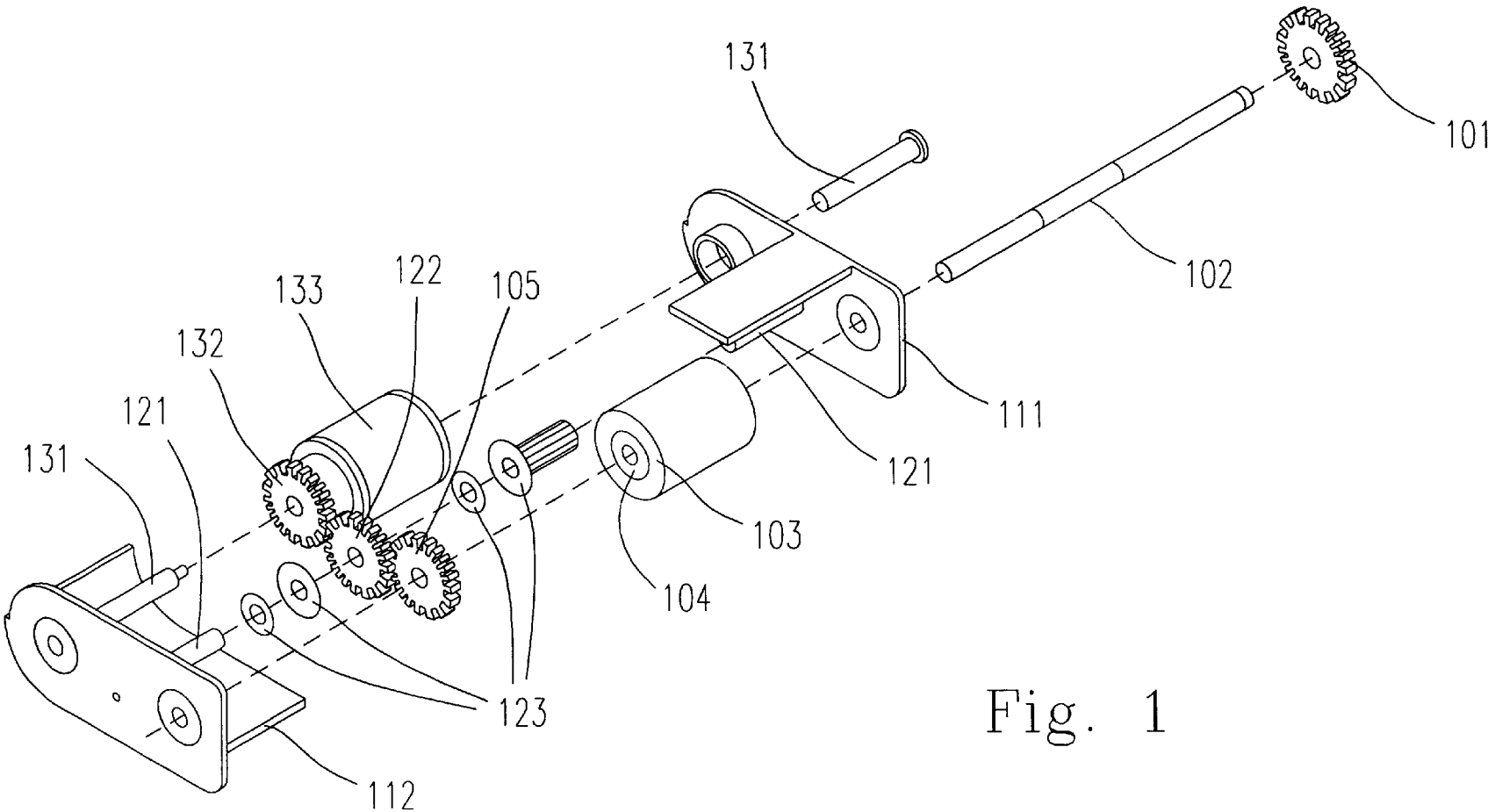
FIG. 1 is a schematic diagram illustrating a sheet feeding apparatus according to the preferred embodiment of the present invention.
Figure 2A:
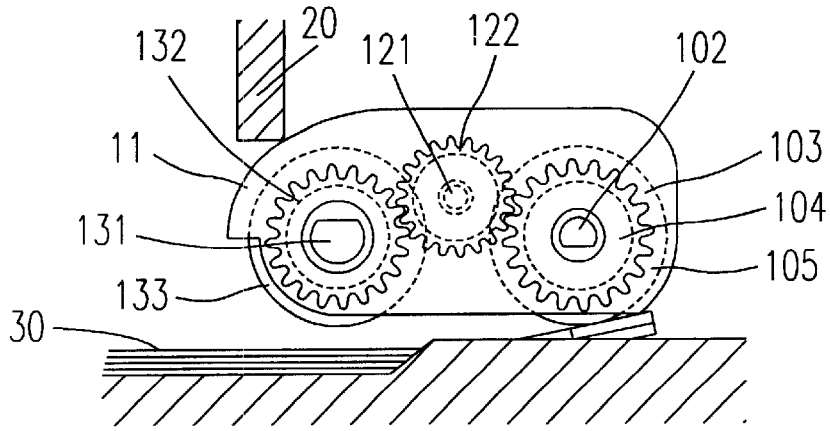
FIGS. 2 (*a*)~(*f*) are schematic diagrams illustrating the sequential actions of feeding a sheet according to a sheet feeding apparatus of the present invention.
Figure 2B:
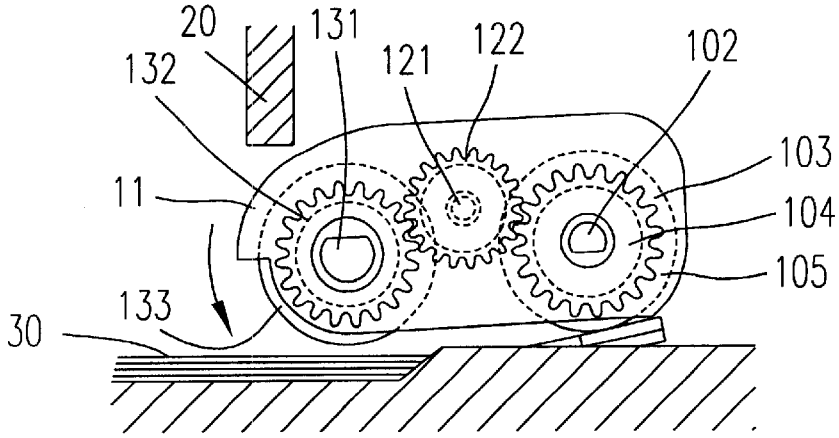
Figure 2C:
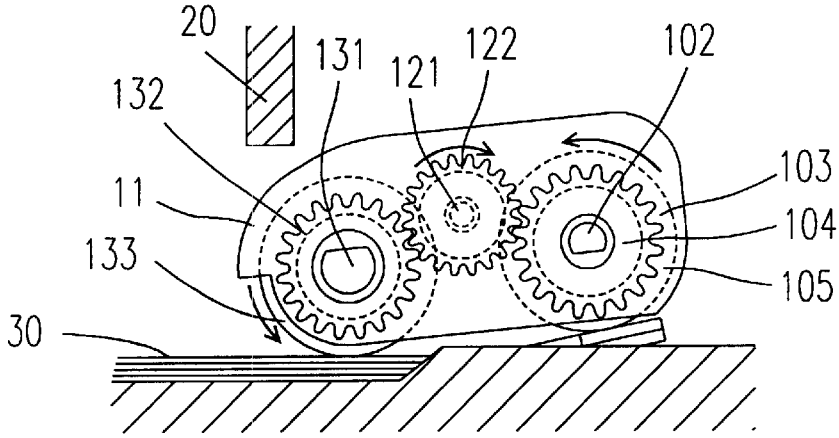
Figure 2D:
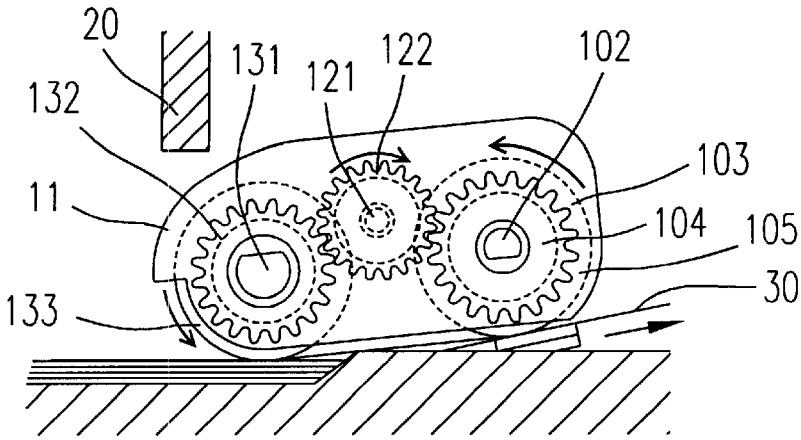
Figure 2E:
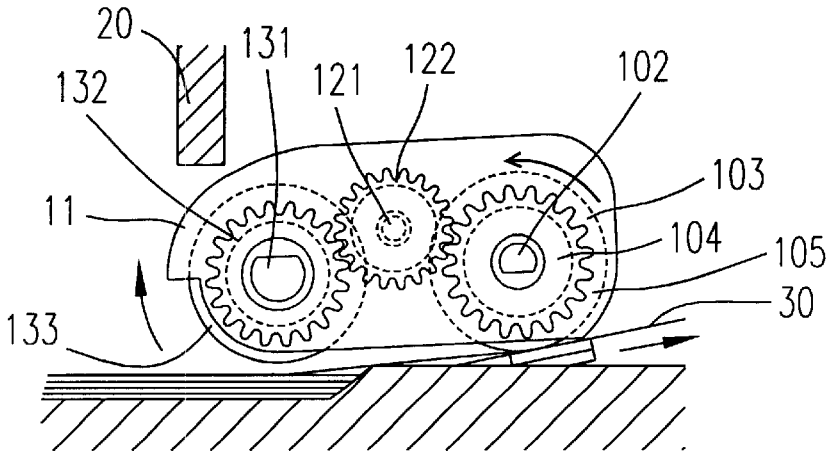
Figure 2F:
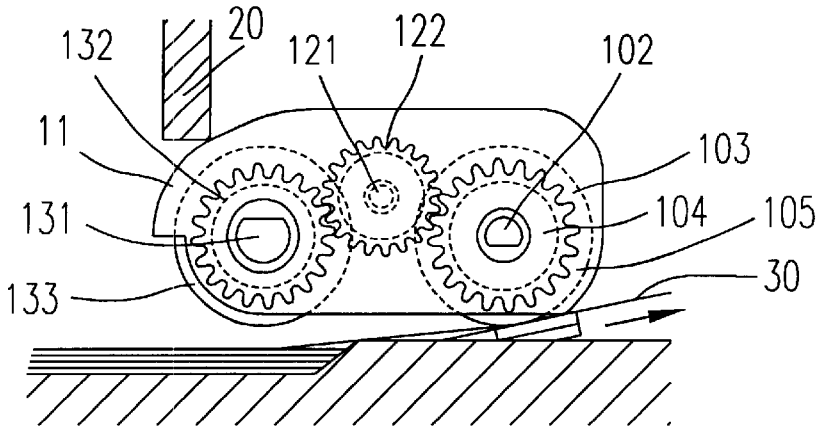

As shown in FIG. 1, a schematic diagram illustrating a sheet feeding apparatus according to the preferred embodiment of the present invention is applied to an automatic sheet feeder. The automatic sheet feeder includes a motor (not shown) for providing power to feed the sheet 30 and a first transmission device which includes a first gear 101, a transmission shaft 102, a separation roller 103, an one way bearing 104 and a second gear 105. The first gear 101 is driven by the motor. Thus, the transmission shaft 102 connected through the first gear 101 rotates therewith. The separation roller 103 is coupled with the one way bearing 104 and rotates therewith. The second gear 105 is coupled with the transmission shaft 102 to drive a second transmission device.

A cantilever 11 is composed of a cantilever upper cover 111 and a cantilever base 112. The transmission shaft 102 is connected through the cantilever upper cover 111 and the cantilever base 112.

The second transmission device includes a connecting shaft 121, a third gear 122 and a torque limiting module 123. The connecting shaft 121 is fixed to the cantilever upper cover 111 and the cantilever base 112. The third gear 122 is coupled with the connecting shaft 121 and meshed with the second gear 105 of the first transmission device. The torque limiting module 123 is mounted on the connecting shaft 121 between the connecting shaft 121 and the third gear 122. The torque limiting module 123 for providing a torque against the third gear 122 rotating along the connecting shaft 121 is composed of two circular washers and two felt rings. When a driving force for driving the third gear 122 is larger than a threshold value, the third gear 122 rotates along the connecting shaft 121.

A third transmission device comprises a sheet feeding shaft 131, a fourth gear 132 and a sheet feeding roller 133. The sheet feeding shaft 131 is coupled with the cantilever upper cover 111 and cantilever base 112. The fourth gear 132 is coupled to the sheet feeding shaft 131 and meshed with the third gear 122. The sheet feeding roller 133 is connected to the fourth gear 132 and also coupled with the sheet feeding shaft 131.

FIGS. 2(*a*)~(*f*) are schematic diagrams illustrating the sequential actions of feeding the sheet 30 according to a sheet feeding apparatus of the present invention. As shown in FIG. 2(*a*), The sheet feeding apparatus is at an initial position (in contact with a stopper 20). As shown in FIG. 2(*b*), when the motor rotates in a first direction, the transmission shaft 102 is driven by the motor to rotate. The cantilever 11 is driven by the transmission shaft 102 to rotate in the first direction along the transmission shaft 102 but the third gear 122 does not rotate owing to the action of the torque limiting module 123. As shown in FIG. 2(*c*), the cantilever 11 moves from the initial position to a sheet feeding position where the sheet feeding roller 133 contact the sheet 30. The fourth gear 132 and the sheet feeding roller 133 is driven by the third gear 122 to feed the sheet 30 while a reaction force of the sheet feeding roller 133 in contact with the sheet 30 is generated to make the driving force for driving the third gear 122 larger than the threshold value and the third gear 122 starts to rotate. As shown in FIG. 2(*d*), the sheet 30 is fed by the sheet feeding roller 133 to the separation roller 103, and the separation roller 103 feeds the sheet 30 into another roller (not shown ). As shown in FIG. 2(*e*), the cantilever 11 driven by motor rotating in the second direction rotates inversely on the transmission shaft 102 and departs from the sheet 30. Owing to the one way bearing 104, the inverse rotation of the transmission shaft 102 can not drive the separation roller 103 in the second direction. Thus, the separation roller 103 keeps moving in the same direction when the sheet 30 is fed by another roller in the same feeding direction. At the same time, owing to the action of the torque limiting module 123, the driving force for driving the third gear 122 is smaller than the threshold value but the third gear 122 does not rotate. Therefore the power of the transmission shaft 102 drives the cantilever 11 to rotate in the second direction along the transmission shaft 102. As shown in FIG. 2(*f*), the cantilever 11 is moved from the sheet feeding position back to the initial position, while the motor rotates in the second direction.

In sum, the present invention has the following advantages:

1. A magnetic valve or another motor to control the motion of the cantilever can be omitted; and
2. The manufacturing cost is high and the structure of the sheet feeding apparatus is simpler.

While the invention has been described in terms of what are presently considered to be the most practical and preferred embodiments, it is to be understood that the invention need not to be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A sheet feeding apparatus, to be used in an automatic sheet feeder having a motor rotatable in a first direction and a second direction, comprising:

a first transmission device driven by said motor for generating a driving force;

a second transmission device driven by said first transmission device when said driving force for driving said second transmission device is larger than a threshold value; and a third transmission device moving between an initial position and a sheet feeding position and driven by said second transmission device to rotate in said first direction for moving from said initial position to said sheet feeding position where said third transmission device is in contact with a sheet while said motor rotates in said first direction and said driving force for driving said second transmission device is smaller than said threshold value so that when said driving force for driving said second transmission device becomes larger than said threshold value, said third transmission device feeds said sheet.

2. A sheet feeding apparatus according to claim 1, wherein said third transmission device will rotate in said second direction to back to said initial position when said driving force for driving said second transmission device further becomes smaller than said threshold value and said motor rotates in said second direction.

3. A sheet feeding apparatus according to claim 1, wherein said first transmission device comprises:

a first gear driven by said motor;

a transmission shaft connected through said first gear;

an one way bearing coupled with said transmission shaft;

a separation roller coupled with said one way bearing and rotating therewith; and a second gear coupled with said transmission shaft to drive said second transmission device.

4. A sheet feeding apparatus according to claim 3, wherein said one way bearing and said separation roller rotate in said first direction on said transmission shaft while said motor rotates in said first direction and are free to rotate in said first direction while said motor rotates in said second direction.

5. A sheet feeding apparatus according to claim 3, further comprising a cantilever coupled with said transmission shaft and connected to said second transmission device and said third transmission device.

6. A sheet feeding apparatus according to claim 5, wherein said second transmission device comprises:

a connecting shaft fixed to said cantilever;

a third gear coupled with said connecting shaft and meshed with said second gear of first transmission device;

a torque limiting module mounted on said connecting shaft between said connecting shaft and said third gear.

7. A sheet feeding apparatus according to claim 6, wherein said third transmission device comprises:

a sheet feeding shaft coupled with said cantilever;

a fourth gear coupled to said sheet feeding shaft and meshed with said third gear; and a sheet feeding roller connected to said fourth gear and also coupled with said sheet feeding shaft, wherein said cantilever is driven by said motor to rotate in said first direction on said transmission shaft to move said sheet feeding roller from said initial position to said sheet feeding position where said sheet feeding roller in contact with said sheet while said driving force for driving said third gear is smaller than said threshold value and said motor rotates in said first direction; said fourth gear and said sheet feeding roller is driven by said third gear to feed said sheet while a reaction force of said sheet feeding roller in contact with said sheet is generated to make said driving force for driving said third gear larger than said threshold value and said third gear starts to rotate; and then said cantilever driven by motor rotating in said second direction rotates inversely on said transmission shaft and is moved from said sheet feeding position to said initial position, while said motor rotates in said second direction and said driving force for driving said third gear is smaller than said threshold value.

* * * * *